US005936617A

United States Patent [19]

Uchino et al.

[11] Patent Number: 5,936,617

[45] Date of Patent: Aug. 10, 1999

[54] DISPLAY APPARATUS

[75] Inventors: Katsuhide Uchino; Toshikazu Maekawa; Yoshiharu Nakajima; Hiroyoshi Tsubota, all of Kanagawa, Japan

[73] Assignee: Sony Corporation, Japan

[21] Appl. No.: 08/627,004

[22] Filed: Apr. 3, 1996

[30] Foreign Application Priority Data

Apr. 11, 1995 [JP] Japan ..... 7-110182

[51] Int. Cl.[6] ..... G09G 5/00

[52] U.S. Cl. ..... 345/204; 345/153; 348/241; 348/312

[58] Field of Search ..... 345/55, 87, 100, 345/92, 94, 88, 99, 204, 208, 213, 212; 348/312, 791, 792, 241–242, 247; 349/42–48, 106; 327/77, 52, 88, 89, 90, 91, 93; 330/252, 275

[56] References Cited

U.S. PATENT DOCUMENTS

| | | | |
|---|---|---|---|
| 4,004,240 | 1/1977 | Crowle | 330/263 |
| 4,393,380 | 7/1983 | Hosokawa et al. | 345/92 |
| 4,496,967 | 1/1985 | Sase et al. | 348/242 |
| 4,803,554 | 2/1989 | Pape | 345/185 |
| 4,825,203 | 4/1989 | Takeda et al. | 345/88 |
| 4,881,066 | 11/1989 | Kanno et al. | 345/92 |
| 4,947,169 | 8/1990 | Smith et al. | 341/121 |
| 5,168,379 | 12/1992 | Mori et al. | 348/246 |
| 5,216,509 | 6/1993 | Hirasawa | 348/241 |
| 5,335,023 | 8/1994 | Edwards | 345/100 |
| 5,381,175 | 1/1995 | Sudo et al. | 348/246 |
| 5,406,329 | 4/1995 | Kashimura et al. | 348/265 |
| 5,489,910 | 2/1996 | Kuwata | 345/212 |
| 5,515,103 | 5/1996 | Ito | 348/312 |
| 5,572,155 | 11/1996 | Tamayama | 348/242 |
| 5,717,457 | 2/1998 | Morimoto | 348/241 |

FOREIGN PATENT DOCUMENTS

| | | |
|---|---|---|
| 0 551 910 | 7/1993 | European Pat. Off. . |
| 0 554 051 | 8/1993 | European Pat. Off. . |
| 0 572 250 | 12/1993 | European Pat. Off. . |
| 2 233 848 | 1/1991 | United Kingdom . |

OTHER PUBLICATIONS

<<Electronic Circuits>> by Donald L. Schilling 1979, pp. 314–315.

*Primary Examiner*—Lun-Yi Lao

*Attorney, Agent, or Firm*—Rader, Fishman & Grauer; Ronald P. Kananen

[57] ABSTRACT

The invention provide a display apparatus of a plural pixel simultaneous driving system wherein sample and hold noise included in a video signal is removed before the video signal is supplied to a display panel. A video signal processing circuit operates in response to a timing signal supplied from an external timing signal source, and delays an input video signal supplied thereto from an external video signal source to produce an output video signal. The video signal processing circuit includes a first sample and hold circuit, a second sample and hold circuit and a differential circuit. The first sample and hold circuit repetitively samples and holds the input video signal in response to the timing signal. The second sample and hold circuit repetitively samples and holds a predetermined reference signal in response to the same timing signal. The differential circuit differentially processes the input video signal after it has been sampled and held and the reference signal after it has been sampled and held to produce an output video signal from which sample and hold noise synchronized with the timing signal has been removed.

9 Claims, 11 Drawing Sheets

DISPLAY APPARATUS

BACKGROUND OF THE INVENTION

This invention relates generally to a display apparatus which includes a display panel, a video driver and a timing generator. The invention relates specifically to a driving control technique for a display apparatus which adopts a plural pixel simultaneous sampling system, and more specifically to a technique for removing noise included in a video signal to be supplied from a video driver to a display panel.

A plural pixel simultaneous sampling system is effective as a driving system for a display panel represented by a liquid crystal display panel of the active matrix type and is disclosed, for example, in Japanese Patent Laid-Open No. Hei 4-116687. According to the plural pixel simultaneous driving system, a color display panel includes a plurality of signal lines which are disposed in parallel to each other in a vertical direction. Each successive three signal lines make up a set for the colors of red (R), green (G) and blue (B). Further, the color display panel includes a plurality of gate lines arranged in parallel to each other in a horizontal direction. Furthermore, the color display panel includes pixel electrodes individually connected to intersecting points of the signal lines and the gate lines via respective switching elements. The pixel electrodes are arranged at a predetermined arrangement pitch in a matrix. In addition, the color display panel includes a plurality of horizontal switches individually provided corresponding to the signal lines. Further, the color display panel includes three video lines connected for the individual colors to the signal lines via the horizontal switches and accepts video signals of R, G and B supplied thereto from a video driver. In the plural pixel simultaneous sampling system of the construction described above, a horizontal driving circuit for simultaneously controlling the horizontal switches in units of a set for the colors R, G and B and performs RGB three pixel simultaneous sampling driving. In this instance, a sample and hold unit is provided in the video driver for relatively providing delay amounts corresponding to the arrangement pitch of the pixels to the video signals of R, G and B supplied to the three video lines. By relatively providing the delay amounts corresponding to the arrangement pitch of the pixels to the video signals of R, G and B and controlling opening and closing operations of the horizontal switches simultaneously in units of a set for R, G and B, the number of stages of horizontal driving circuits (for example, shift registers) for driving the horizontal switches is reduced to achieve simplification in construction and also to reduce the power dissipation while a good color display image is obtained. Since the horizontal switches for R, G and B are constructed so that the opening and closing operations thereof are simultaneously controlled by a selection pulse outputted from a shift register, the number of stages of the shift registers is reduced to one third. Further, also the frequency of a horizontal clock signal to be supplied from a timing generator is reduced to one third.

In a display apparatus which adopts the plural pixel simultaneous sampling system, video signals to be inputted to a display panel of the active matrix type are produced by a video driver built in a sample and hold unit. However, an ordinary sample and hold unit produces, at timings at which the on-off operation is changed over alternately, noise originating from sample and hold leakage. Since the noise is supplied in a superposed condition on the video signals to the display panel, the display apparatus has a problem to be solved in that a display defect in the form of a vertical stripe appears on the screen and deteriorates the picture quality remarkably.

SUMMARY OF THE INVENTION

It is an object of the present invention to provide a display apparatus of a plural pixel simultaneous driving system wherein sample and hold noise included in a video signal is removed before the video signal is supplied to a display panel.

In order to attain the object described above, according to an aspect of the present invention, there is provided a display apparatus which comprises a display panel including pixels arranged at intersecting points between gate lines and signal lines which extend perpendicularly to each other, and a driving circuit for distributing a plurality of video signals for individual sets each including a predetermined number of the signal lines to drive a plurality of the pixels at a time, a video driver for relatively delaying a plurality of original video signals in accordance with an arrangement pitch of the pixels to obtain the plurality of video signals and supplying the plurality of video signals to the display panel, and a timing generator for supplying a timing signal to the display panel and the video driver to synchronously control the plural pixel simultaneous driving of the driving circuit and the delaying processing of the video driver. The video driver includes a first sample and hold means for repetitively sampling and holding the original video signals inputted thereto from the outside in response to the timing signal inputted thereto from the timing generator, a second sample and hold means for repetitively sampling and holding a predetermined reference signal in response to the timing signal, and a differential means for differentially processing the original video signals and the reference signal after the signals have been sampled and held to produce video signals from which noise originating from the sampling and holding has been removed. Preferably, the second sample and hold means repetitively samples and holds the reference signal of a fixed voltage and intentionally adds noise originating from the sampling and holding.

In a display apparatus which adopts the-plural pixel simultaneous driving system, sample and hold noises produced by RGB video drivers cause a vertical stripe or a like display defect on the display screen. Therefore, in the present invention, sample and hold noise produced by a video driver is intentionally produced separately from a processing system for an actual video signal, and they are differentially processed (subtraction processed) with each other to erase the noise from the output video signal. In particular, separately from the processing system for an actual video signal, a processing system for a reference signal (dummy signal) provided, and sample and hold noise of the same timing is produced artificially by the processing system for the reference signal. By differentially processing the outputs of the two signal processing systems, the sample and hold noises included in both of them cancel each other. Consequently, since the video signal to be supplied from the video driver to the display panel does not include any sample and hold noise, a display defect such as a vertical stripe can be suppressed. Accordingly, the display apparatus is advantageous in that it provides an improved picture quality.

According to another aspect of the present invention, the display apparatus is driven by a driving method which comprises the steps of repetitively sampling and holding, by means of said video driver, the original video signals inputted from the outside in response to the timing signal inputted from said timing generator, repetitively sampling and holding a predetermined reference signal simultaneously in response to the timing signal, and differentially processing the original video signals after the signals are sampled and held and the reference signal after it has been sampled and held to produce a video signal from which noise originating from the sampling and holding has been removed. Preferably, the reference signal of a fixed voltage is repetitively sampled and held to intentionally add noise originating from the sampling and holding.

According to a further aspect of the present invention, there is provided a video signal processing circuit for delaying an input video signal supplied thereto from the outside in response to a timing signal supplied thereto from the outside to produce an output video signal, which comprises a first sample and hold means for repetitively sampling and holding the input video signal in response to the timing signal, a second sample and hold means for repetitively sampling and holding a predetermined reference signal in response to the timing signal, and a differential means for differentially processing the input video signal and the reference signal after the signals are sampled and held to produce an output video signal from which sample and hold noise synchronized with the timing signal has been removed.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
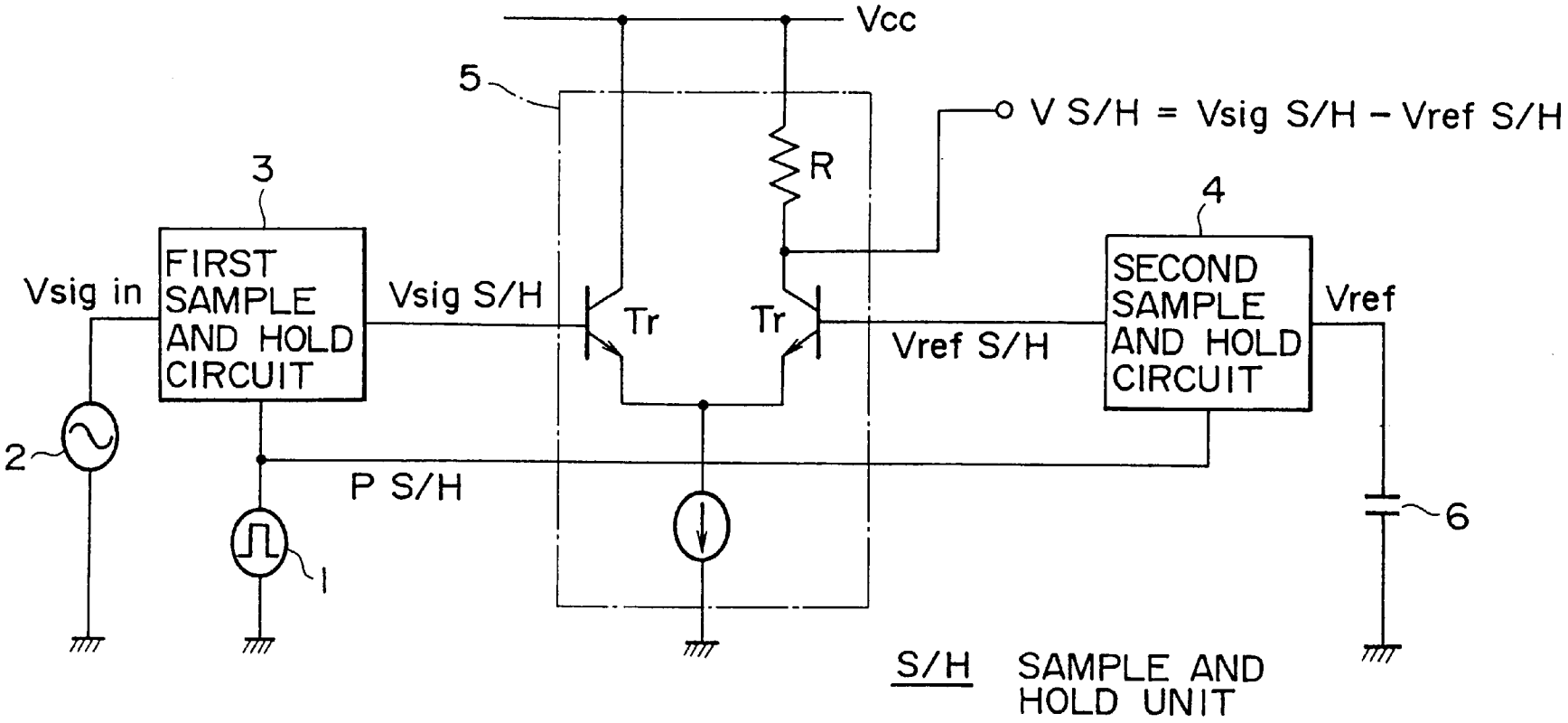
FIG. 1 is a block diagram showing a basic construction of a video signal processing circuit to which the present invention is applied.

Referring first to FIG. 1, there is shown in block diagram a basic construction of a video signal processing circuit to which the present invention is applied. The video signal processing circuit operates in response to a timing signal (latch signal) PS/H supplied thereto from an external timing signal source 1 and delays an input video signal (original video signal) Vsigin supplied similarly from an external video signal source 2 to produce an output video signal VS/H. The video signal processing circuit includes a first sample and hold circuit 3, a second sample and hold circuit 4, and a differential circuit 5. The first sample and hold circuit 3 repetitively samples and holds the input video signal Vsigin in response to the timing signal PS/H. The second sample and hold circuit 4 repetitively samples and holds a predetermined reference signal Vref in response to the timing signal PS/H. It is to be noted that, in the circuit arrangement shown in FIG. 1, a signal of a fixed voltage supplied from a reference signal source 6 is used as the reference signal Vref. The differential circuit 5 differentially processes an input video signal VsigS/H after it is sampled and held and a reference signal VrefS/H after it is sampled and held to produce an output video signal VS/H from which sample and hold noise synchronized with the timing signal PS/H has been removed. In other words, VS/H=VsigS/H−VrefS/H. It is to be noted that the differential circuit 5 is formed of an input transistor Tr, an output transistor Tr, a load resistor R and so forth. The video signal processing circuit having the construction described above is incorporated as a sample and hold unit S/H into, for example, a video driver.

Figure 2:
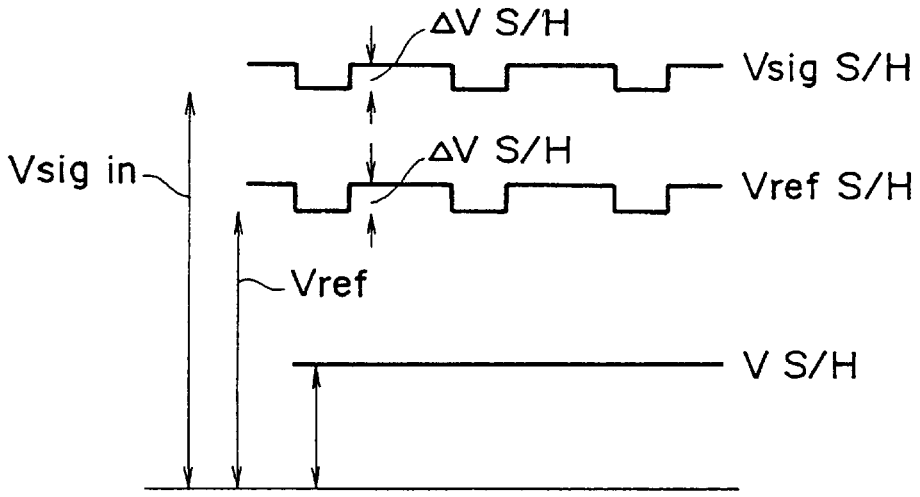
FIG. 2 is a waveform diagram illustrating operation of the video signal processing circuit shown in FIG. 1.

Referring now to FIG. 2, operation of the video signal processing circuit (sample and hold unit S/H) shown in FIG. 1 is illustrated. The first sample and hold circuit 3 samples and holds the input video signal Vsigin to produce the video signal VsigS/H. A noise ΔVS/H synchronized with the latch signal PS/H is superposed with the video signal VsigS/H. Meanwhile, the second sample and hold circuit 4 samples and holds the reference signal Vref to produce the reference signal VrefS/H. Also the reference signal VrefS/H includes a noise ΔVS/H of an equal amount superposed with the reference signal Vref. The differential circuit 5 thus performs differential processing between the video signal VsigS/H and the reference signal VrefS/H to form an output video signal VS/H from which the noise ΔVS/H has been removed.

Figure 3:
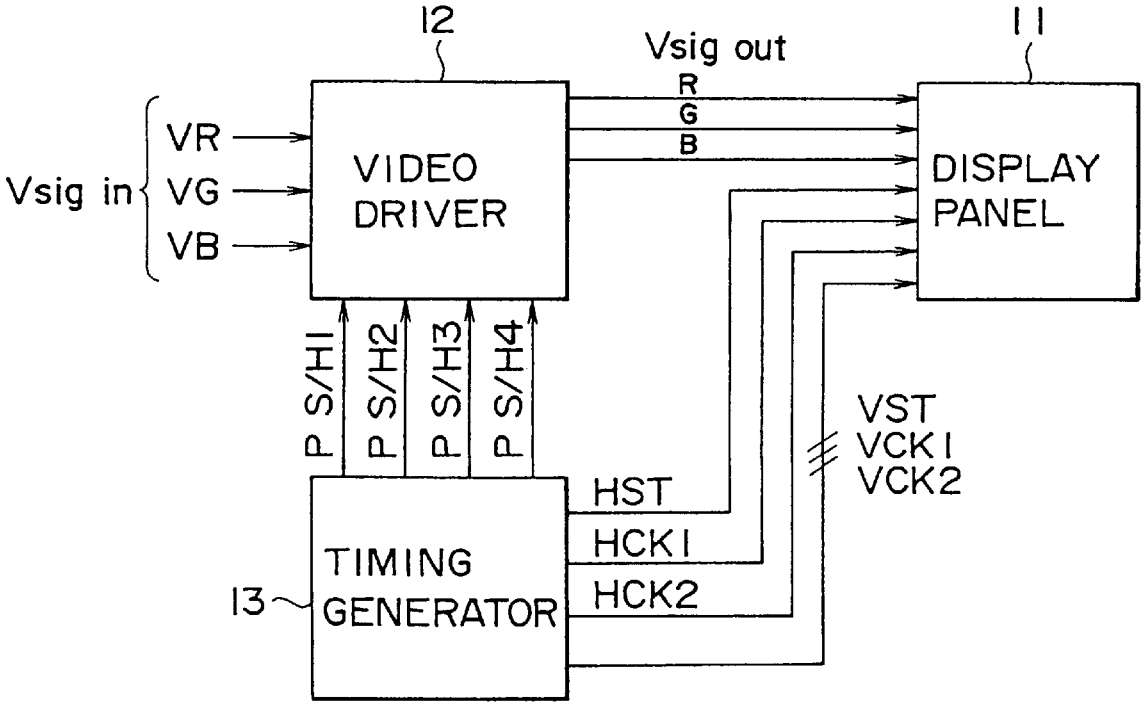
FIG. 3 is a block diagram showing a general construction of a display apparatus to which the present invention is applied.

FIG. 3 shows in block diagram a basic construction of a display apparatus to which the present invention is applied. Referring to FIG. 3, the display apparatus shown includes a display panel 11, a video driver 12, and a timing generator 13. The display panel 11 includes pixels arranged at intersecting points between gate lines and signal lines which extend perpendicularly to each other, and a horizontal driving circuit for distributing a plurality of video signals Vsigout (in the present example, three video signals separated to systems of the three primary RGB colors) for individual sets each including a predetermined number of (three in the present arrangement) the signal lines to drive a plurality of the pixels at a time. It is to be noted that the horizontal driving circuit operates in response to a pair of horizontal clock signals HCK1 and HCK2 and successively transfers a predetermined horizontal start signal HST to perform the three pixel simultaneous driving described above. Further, the display panel 11 has, in addition to the horizontal driving circuit, a built-in vertical driving circuit which sequentially scans the gate lines. The vertical driving circuit operates in response to a pair of vertical clock signals VCK1 and VCK2 and successively transfers a vertical start signal VST to sequentially select the gate lines. The video driver 12 relatively delays a plurality of original video signals Vsigin (in the present example, video signals of the three systems of VR, VG and VB) in accordance with an arrangement pitch of the pixels and supplies video signals Vsigout of the three RGB systems described above to the display panel 11. The timing generator 13 supplies timing signals such as the horizontal start signal HST and the horizontal clock signals HCK1 and HCK2 to the horizontal driving circuit of the display panel 11 to control the three pixel simultaneous driving described above. Further, the timing generator 13 supplies timing signals such as the vertical start signal VST and the vertical clock signals VCK1 and VCK2 to the vertical driving circuit of the display panel 11 to control the line sequential scanning of the gate lines. Furthermore, the timing generator 13 supplies timing signals (latch signals) such as timing signals PS/H1, PS/H2, PS/H3 and PS/H4 to the video driver 12 to control operation of the video driver 12. Consequently, the timing generator 13 can synchronously control the three pixel simultaneous driving of the display panel 11 and the delaying processing (sample and hold processing) of the video driver 12.

Figure 4:
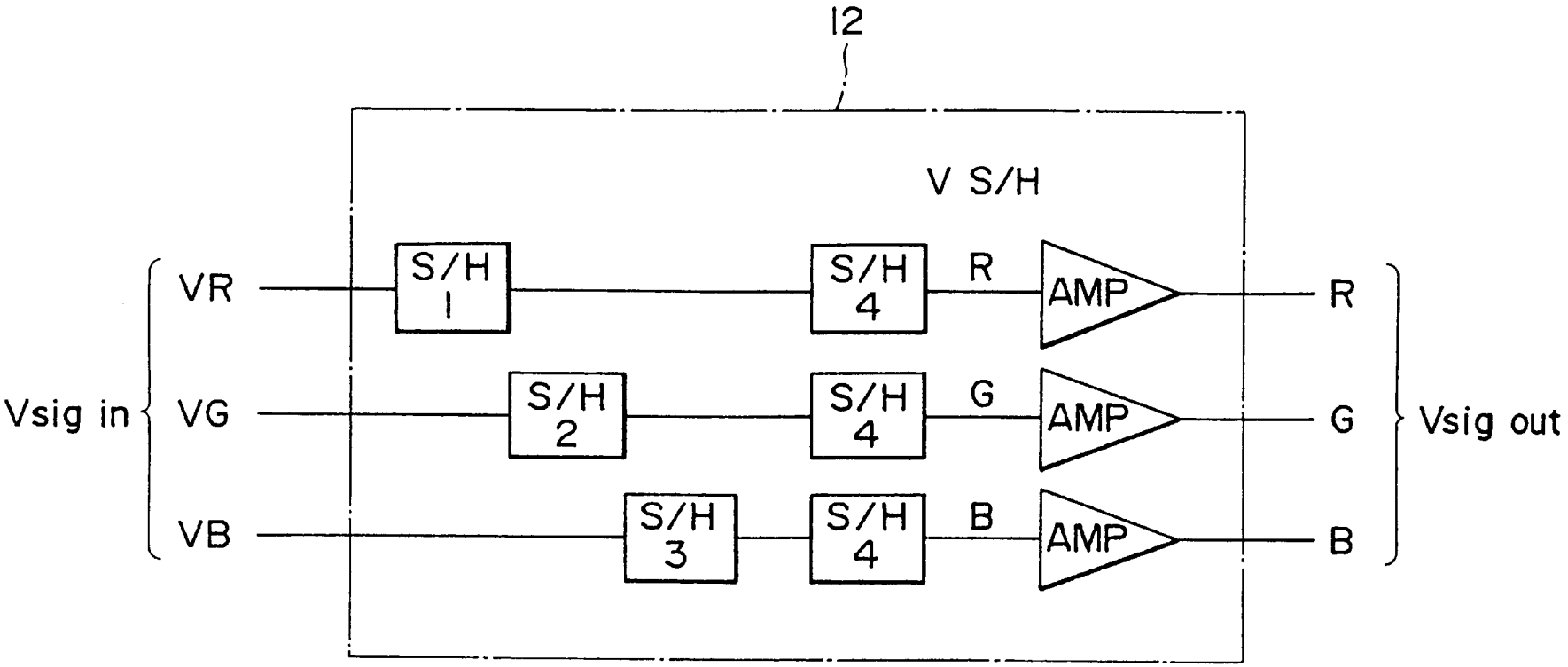
FIG. 4 is a block diagram showing an example of a construction of a video driver incorporated in the display apparatus shown in FIG. 3.

FIG. 4 shows in block diagram an example of a detailed construction of the video driver 12 shown in FIG. 3. As described hereinabove, the video driver 12 relatively delays the original video signals Vsigin of the three VR, VG and VG systems in accordance with the arrangement pitch of the pixels to adjust the supply timings of the video signals Vsigout of the three RGB systems to the display panel 11. In the present arrangement, the video driver 12 has an analog construction and includes sample and hold units S/H which perform delaying processing of the original video signals Vsigin. In particular, the video driver 12 includes three front stage sample and hold units S/H1, S/H2 and S/H3 corresponding to the original video signals Vsigin of the three VR, VG and VB systems. The video driver 12 further includes three rear stage sample and hold units S/H4 individually connected to the front stage sample and hold units S/H1, S/H2 and S/H3. A delay channel corresponding to the VR system is formed of a set of the front stage sample and hold unit S/H1 and a corresponding one of the rear stage sample and hold units S/H4; another delay channel corresponding to the VG system is formed of a set of the front stage sample and hold unit S/H2 and a corresponding one of the rear stage sample and hold units S/H4; and a further delay channel corresponding to the VB system is formed of a set of the front stage sample and hold unit S/H3 and a corresponding one of the rear stage sample and hold units S/H4. The front stage sample and hold units S/H1, S/H2 and S/H3 are controlled in synchronism with each other. It is to be noted that an amplifier AMP is connected to the output stage of each one of the delay channels. In the present example, the original video signals Vsigin of the three VR, VG and VB systems are distributed to the three delay channels, and the video signals Vsigout of the relatively delayed three RGB systems are outputted. Here, at least the three rear stage sample and hold units S/H4 have the video signal processing circuit construction shown in FIG. 1 and remove, from the output video signals Vsigout of the three RGB systems, noise originating from the sampling and holding. It is to be noted that naturally the video signal processing circuit construction shown in FIG. 1 may be adopted also for the front stage sample and hold units S/H1, S/H2 and S/H3.

Figure 5:
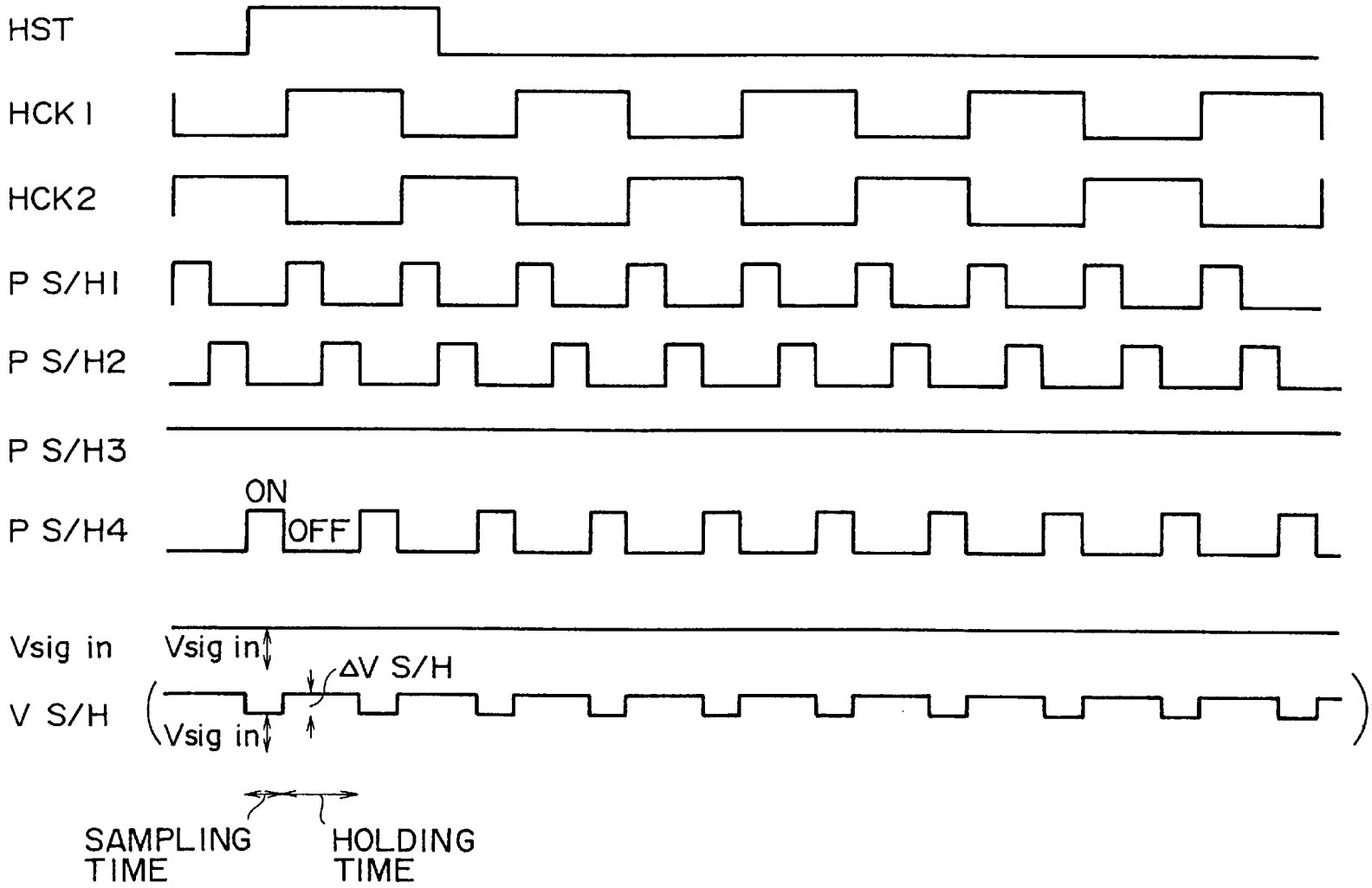
FIG. 5 is a waveform diagram illustrating timing signals supplied from a timing generator incorporated in the display apparatus shown in FIG. 3.

FIG. 5 shows waveforms of various timing signals supplied from the timing generator 13 shown in FIG. 3. As described hereinabove, the timing generator 13 operates in response to a synchronizing signal inputted thereto from the outside and supplies the horizontal start signal HST, the horizontal clock signals HCK1, HCK2 and so forth to the display panel 11 to control driving of the display panel 11. Though not shown, the timing generator 13 additionally supplies the vertical start signal VST and the vertical clock signals VCK1 and VCK2 to the display panel 11. Further, the timing generator 13 supplies a plurality of latch signals PS/H1, PS/H2, PS/H3 and PS/H4 to the sample and hold units of the video driver 12. The processing timings of the sample and hold units included in the delay channels of the three systems are defined by those latch signals. In particular, the first front stage sample and hold unit S/H1 is first caused to intermittently operate in response to the latch signal PS/H1. Then, the second front stage sample and hold unit S/H2 is caused to intermittently operate in response to the latch signal PS/H2 while the third front stage sample and hold unit S/H3 is caused to continuously operate in response to the latch signal PS/H3. Further, after the latch signal PS/H2 is outputted, the latch signal PS/H4 is outputted so that the three rear stage sample and hold units S/H4 are caused to intermittently operate all at once. In particular, the potentials of the original video signals Vsigin held by the front stage sample and hold units S/H1, S/H2 and S/H3 are re-sampled at a timing at which the rear stage sample and hold units S/H4 are turned on, and are supplied to the display panel 11 side. The display panel 11 can simultaneously select the video signals of the three systems by horizontal switches. Naturally, the front stage sample and hold units S/H1, S/H2 and S/H3 have phases shifted relative to each other. Accordingly, time information included in the video signals is not lost. In this manner, when plural pixel simultaneous driving is performed in the display panel, in order that time information included in the video signals may not be lost, the original video signals Vsigin are first sampled by the front stage sample and hold units S/H1, S/H2 and S/H3 having phases displaced from each other, and then sampled by the sample and hold units S/H4 at the rear stage so that they may be selected simultaneously at a suitable timing in the display panel.

Here, at least the rear stage sample and hold units S/H4 have the video signal processing circuit construction shown in FIG. 1 as described above and each produces a video signal VS/H from which noise originating from sampling and holding has been removed. The waveform of the video signal VS/H when it is assumed that no noise removal is performed is indicated at the lowest stage in FIG. 5. If no countermeasure is taken, then at a timing at which the latch signal PS/H4 falls, a noise ΔVS/H which originates from sample and hold leakage is superposed as an offset to the original video signal Vsigin. In particular, within a sampling time within which the latch signal PS/H4 is in an on state, the video signal VS/H exhibits a potential equal to that of the input video signal Vsigin, but within a holding time within which the latch signal PS/H4 is in an off state, the output video signal VS/H is equal to Vsigin+ΔVS/H. The video signal VS/H is amplified by the succeeding amplifier AMP, and a final output video signal Vsigout is supplied to the display panel side. Since such noise ΔVS/H causes a vertical stripe on the display screen, in the present invention, the video signal processing circuit construction shown in FIG. 1 is adopted for the rear stage sample and hold units S/H4 to remove the noise ΔVS/H in advance.

Figure 6:
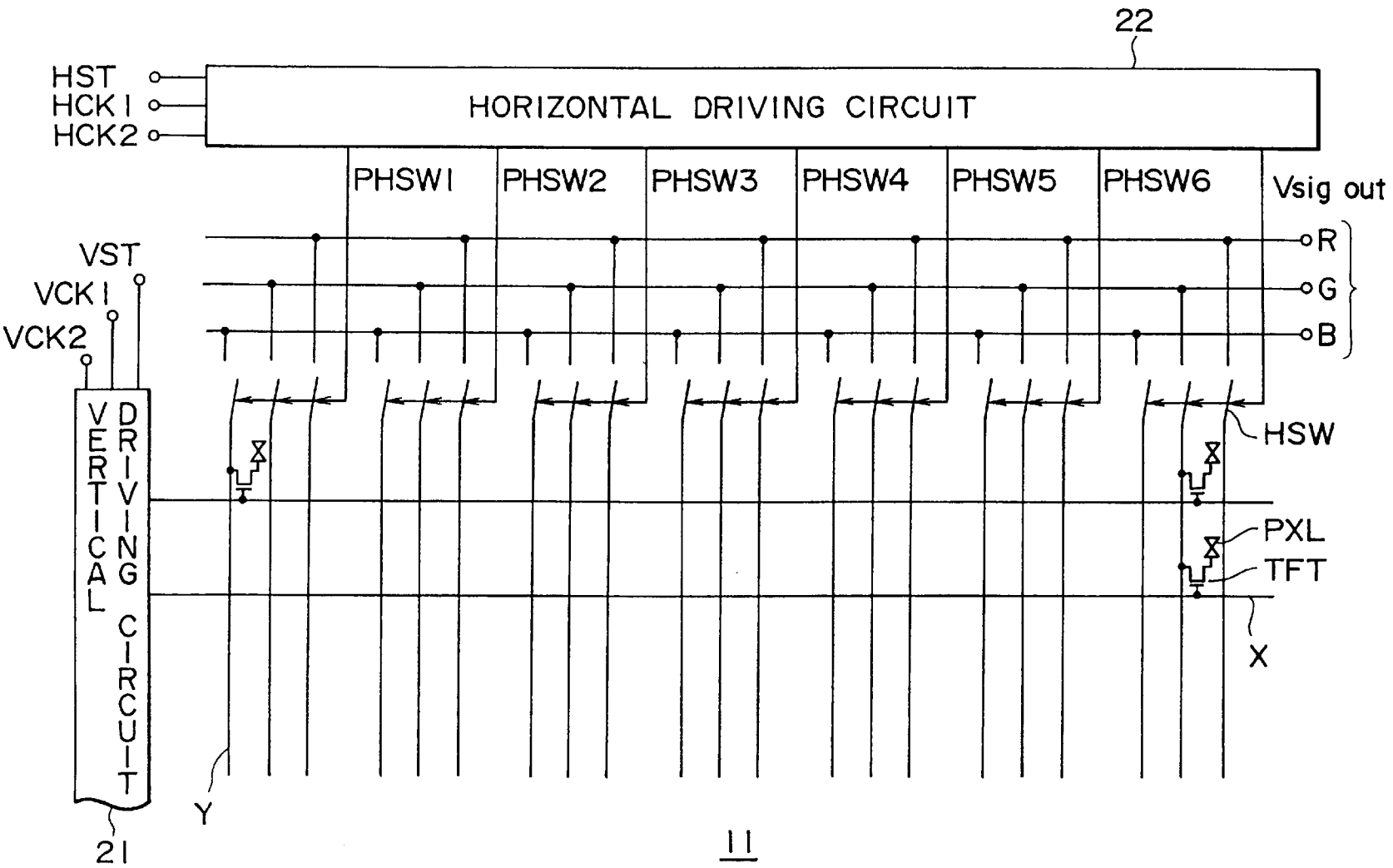
FIG. 6 is a block diagram showing an example of a detailed construction of a display panel incorporated in the display apparatus shown in FIG. 3.

FIG. 6 shows an example of a detailed construction of the display panel 11 shown in FIG. 3. The display panel 11 includes a pixel array section and a peripheral driving circuit section. The pixel array section includes liquid crystal pixels PXL arranged at individual intersecting points between gate lines x and signal lines Y which extend perpendicularly to each other. Each of the pixels PXL is driven by a switching element formed of a thin film transistor TFT. The gate electrode of the thin film transistor TFT is connected to a corresponding gate line X, the source electrode is connected to a corresponding signal line Y, and the drain electrode is connected to a pixel electrode of a corresponding liquid crystal pixel PXL. Further, though not shown, an opposing electrode is disposed in an opposing relationship to each pixel electrode with a predetermined gap left therebetween, and liquid crystal is enclosed in the gap. Meanwhile, the peripheral driving circuit section is divided into a vertical driving circuit 21 and a horizontal driving circuit 22. The vertical driving circuit 21 is connected to the gate lines X and sequentially selects the pixels PXL of one line. In particular, the vertical driving circuit 21 includes a shift register, and it successively transfers the vertical start signal VST in response to the vertical clock signals VCK1 and VCK2 and outputs a gate pulse to each gate line X. On the other hand, the horizontal driving circuit 22 samples the video signals Vsigout of the three RGB systems at a time and distributes them all at once to a predetermined number (three in the present example) of the signal lines Y. In particular, a plurality of horizontal switches HSW are interposed between the horizontal driving circuit 22 and the signal lines Y. Each of the horizontal switches HSW is connected commonly to three signal lines Y. The video signals Vsigout of the three RGB systems are sampled at a time at the three corresponding signal lines Y via the individual horizontal switches HSW. The horizontal driving circuit 22 successively transfers the horizontal start signal HST in response to the horizontal clock signals HCK1 and HCK2 supplied thereto from the timing generator 13 and outputs selection pulses PHSW1, PHSW2, PHSW3, . . . In response to the selection pulses PHSW, the corresponding horizontal switches HSW are controlled to be opened or closed so that simultaneous sampling described above is performed.

Figure 7:
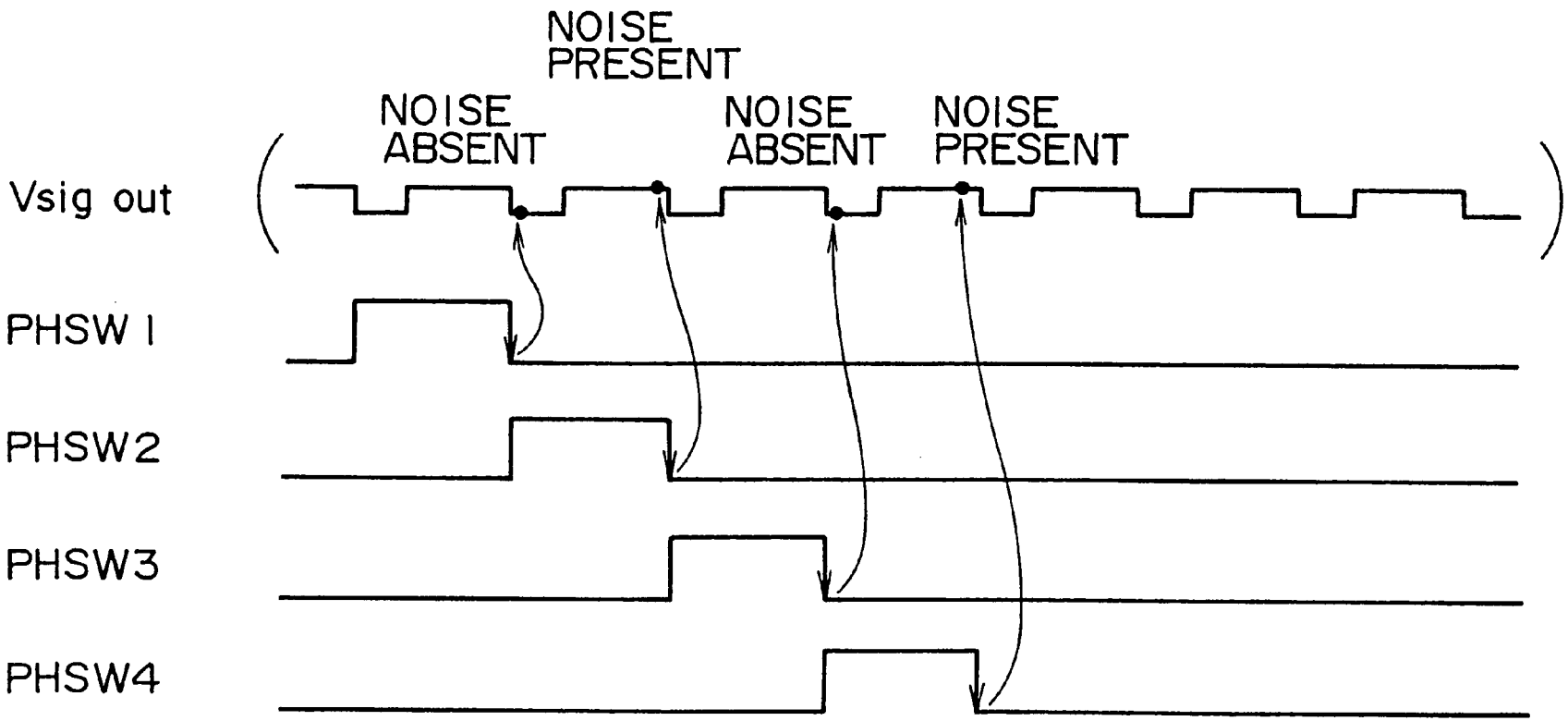
FIG. 7 is a waveform diagram illustrating description of operation of the display panel shown in FIG. 6.

FIG. 7 illustrates with a timing chart the relationship between each of the video signals Vsigout inputted to the display panel 11 and the selection pulses PHSW. As described hereinabove, noise has been removed from the video signal Vsigout, and there is no problem if the selection pulses PHSW have a dispersion from one another. Here, in order to facilitate understanding of the invention, a condition wherein noise is contained in the video signal Vsigout is illustrated in FIG. 7. Here, the sampling timing in the display panel is the point of time of a falling edge of each of the selection pulses PHSW. Since the phases of the selection pulses PHSW have a little dispersion from each other, the potentials of the video signal Vsigout sampled are different among different sets of three signal lines, and they appear as a vertical stripe on the screen. For example, those signal lines Y sampled in response to the selection pulses PHSW1 and PHSW3 are held at a signal level to be used for actual writing, but those signal lines Y sampled in response to the selection pulses PHSW2 and PHSW4 exhibit a little higher signal level. This appears as a vertical stripe and deteriorates the picture quality significantly. For example, with a display panel of a normally white mode, signal lines which sample noise will have a tinge of black. Therefore, in the present invention, sample and hold noise included in the video signal Vsigout is removed on the video driver side in advance so that, even if the selection pulses PHSW exhibit some dispersion on the display panel side, no vertical stripe may appear.

Figure 8:
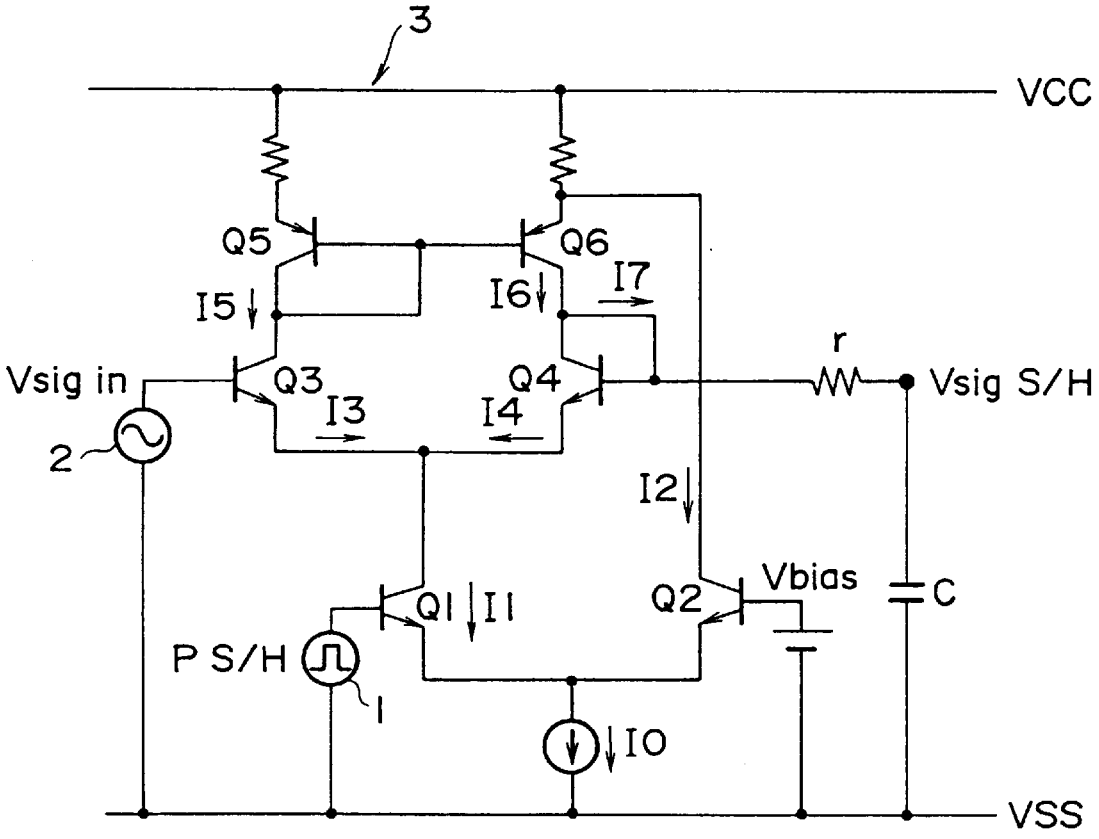
FIG. 8 is a circuit diagram showing an example of a construction of a first sample and hold circuit included in the video signal processing circuit shown in FIG. 1.

FIG. 8 shows in circuit diagram an example of a detailed construction of the first sample and hold circuit 3 included in the video signal processing circuit (sample and hold unit S/H) shown in FIG. 1. Referring to FIG. 8, the first sample and hold circuit 3 operates in response to the latch signal PS/H inputted thereto from the timing signal source 1 such as a timing generator and repetitively samples and holds the video signal Vsigin inputted thereto from the video signal source 2 such as a video decoder. The input video signal VsigS/H, after it is sampled and held, is taken out via a load resistor r and a load capacitor C. As seen from FIG. 8, the first sample and hold circuit 3 is formed of six transistors Q1 to Q6.

Figure 9:
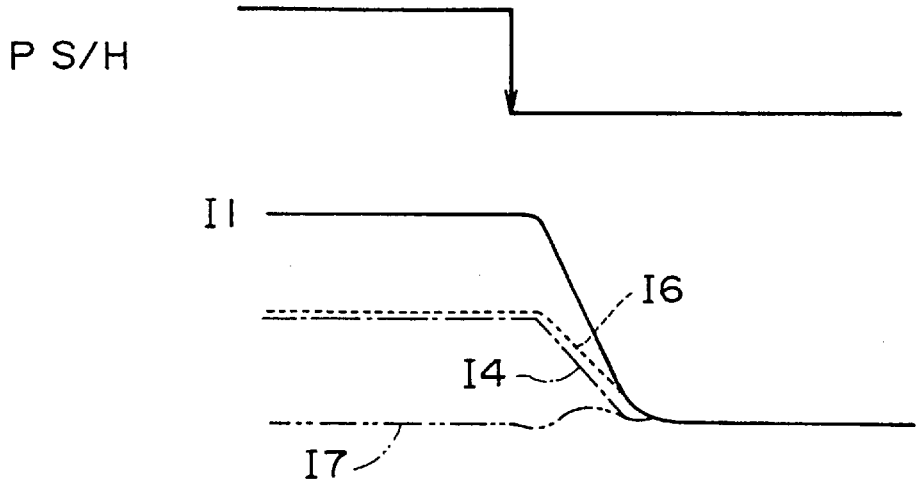
FIG. 9 is a waveform diagram illustrating operation of the first sample and hold circuit shown in FIG. 8.

Operation of the first sample and hold circuit 3 shown in FIG. 8 will be described in detail with reference to FIG. 9. When the latch signal PS/H is at the high level, the transistor Q2 to whose base terminal a predetermined bias voltage Vbias is applied exhibits an off state while current I1 flows through a system of the transistor Q1. Consequently, the input video signal VsigS/H exhibits a potential equal to that of the input video signal Vsigin. However, when the latch signal PS/H falls from the high level to the low level, the timings at which currents flowing through individual nodes are cut are different. In particular, currents I3 and I4 fall first, and then, currents I5 and I6 fall. Consequently, the difference I7 (I6−I4) between the currents I6 and I4 does not flow between the collector and the emitter of the transistor Q4, but flows to the output terminal side. In particular, at this point of time, since the transistor Q4 is in an off state, the residual current I7 (I6−I4) misses its escape and appears at the output terminal. Consequently, the video signal VsigS/H exhibits different values upon sampling and upon holding, and this makes a noise ΔVS/H. Therefore, according to the present invention, the second sample and hold circuit 4 is provided in addition to the first sample and hold circuit 3, and a predetermined reference signal is repetitively sampled and held in response to the same latch signal PS/H to intentionally produce a noise ΔVS/H of an equal amount. Then, the video signal VsigS/H, after it is sampled and held, and the reference signal, after it is sampled and held similarly are differentially processed to remove the noise ΔVS/H originating from the sampling and holding. It is to be noted that, as a result of the differential processing, a DC level is added to the sample and hold video signal VS/H. However, the DC component is clamped in the video driver, and the DC offset does not matter at all.

Figure 10:
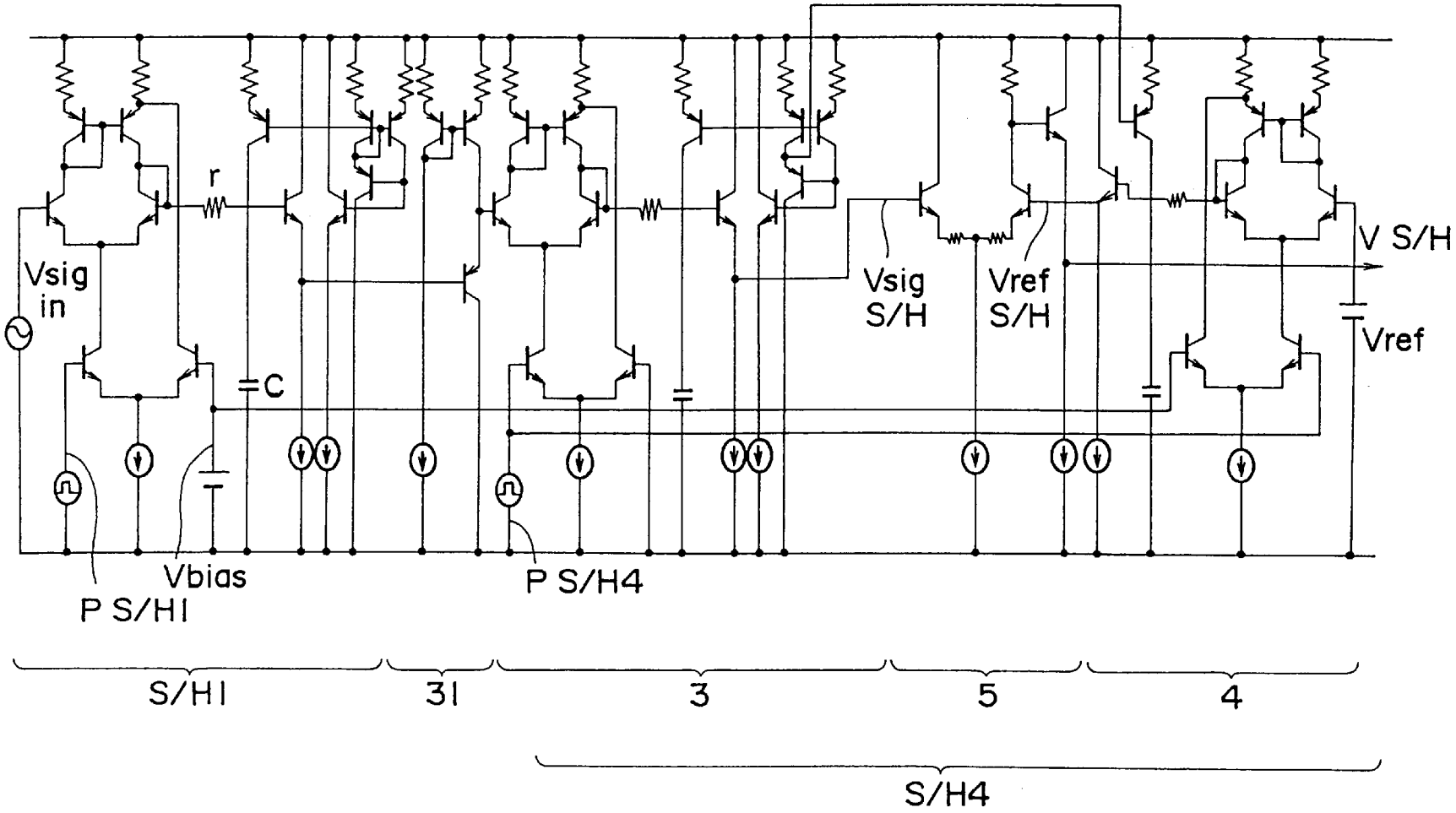
FIG. 10 is a circuit diagram showing an example of a detailed construction of the video signal processing circuit shown in FIG. 1.

FIG. 10 shows in circuit diagram an example of a detailed construction of the video signal processing circuit (sample and hold unit) shown in FIG. 1. The video signal processing circuit shown is applied to a set of the front stage sample and hold unit S/H1 and the corresponding rear stage sample and hold unit S/H4 constructing a channel of the R system included in the video driver 12 shown in FIG. 4. Here, the front stage sample and hold unit S/H1 has an ordinary construction, and the rear stage sample and hold unit S/H4 has a noise removing function in accordance with the present invention. As shown in FIG. 10, the front stage sample and hold unit S/H1 and the rear stage sample and hold unit S/H4 are connected to each other with an emitter follower 31 interposed therebetween. The front stage sample and hold unit S/H1 has a construction similar to that of the first sample and hold circuit 3 shown in FIG. 8. In other words, the front stage sample and hold unit S/H1 of the ordinary structure is formed only of the first sample and hold circuit shown in FIG. 8 and does not have a removing function for sample and hold noise at all. However, naturally the front stage sample and hold unit S/H1 may alternatively have a sample and hold function built therein. In contrast, the rear stage sample and hold unit S/H4 is formed of a first sample and hold circuit 3, a second sample and hold circuit 4 and a differential circuit 5. The first sample and hold circuit 3 and the second sample and hold circuit 4 have a basically same construction. The first sample and hold circuit 3 repetitively samples and holds an input video signal supplied thereto from the front stage sample and hold unit S/H1 in response to a latch signal PS/H4. Also the second sample and hold circuit 4 operates in response to the same latch signal PS/H4 and repetitively samples and holds a predetermined reference signal Vref. The differential circuit 5 differentially processes the video signal VsigS/H after sampled and held and the reference signal VrefS/H after sampled and held to produce an output video signal VS/H from which sample and hold noise synchronized with the latch signal PS/H4 has been removed.

Figure 11:
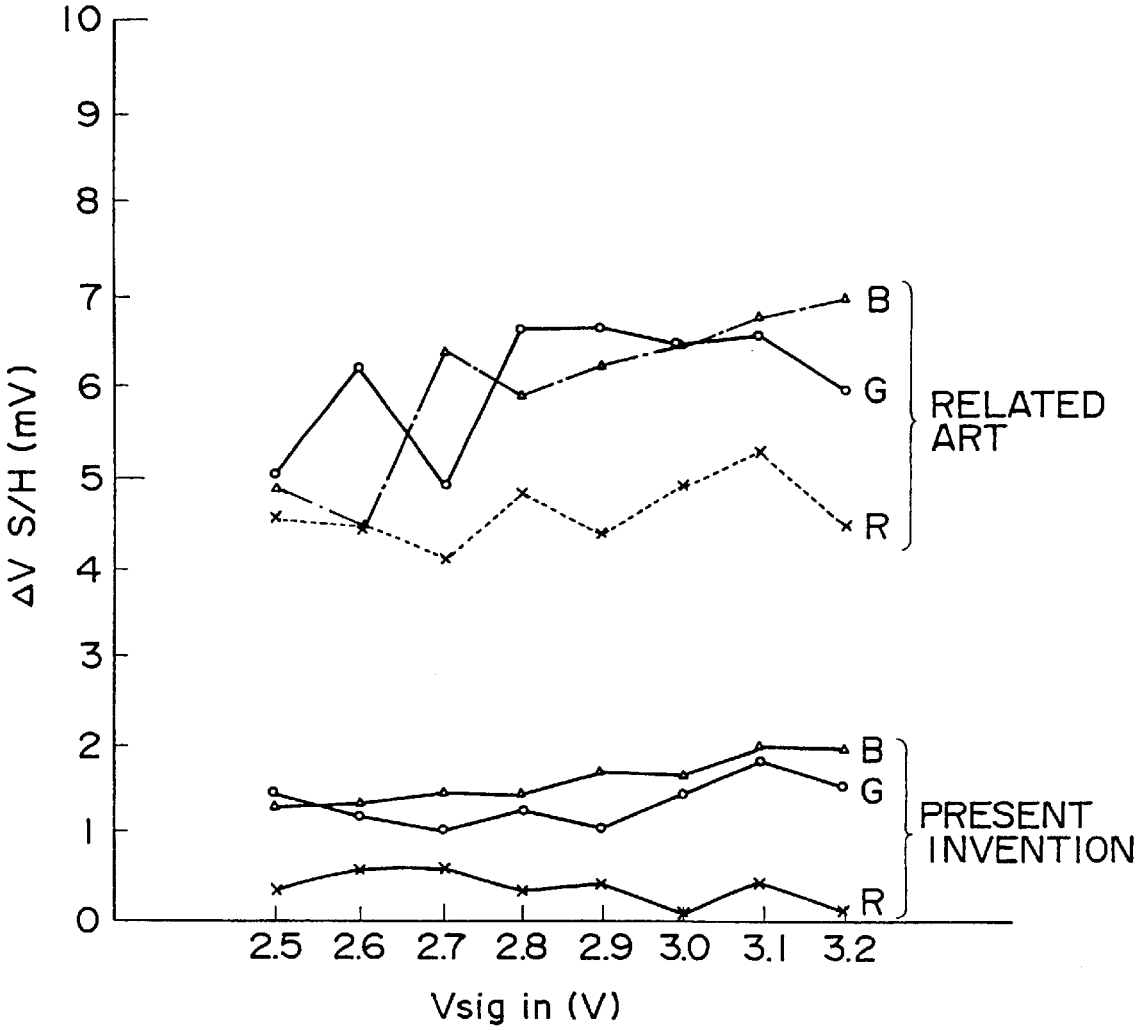
FIG. 11 is a graph illustrating a relationship between an input video signal to the video driver shown in FIG. 4 and a noise included in an output video signal.

FIG. 11 illustrates in with a graph the result of a simulation wherein sample and hold noise is compared in magnitude between an arrangement of the related art and the arrangement of the present invention. Referring to FIG. 11, the axis of abscissa represents the input video signal Vsigin in units of V, and the axis of ordinate represents the magnitude of the noise ΔVS/H in units of mV. The input video signal Vsigin is varied stepwise for the individual three RGB systems to individually detect the noises ΔVS/H by simulation. As apparently seen from the graph, comparing with the related art arrangement, the noise ΔVS/H can be reduced to approximately one fourth to one fifth with the arrangement of the present invention.

Figure 12:
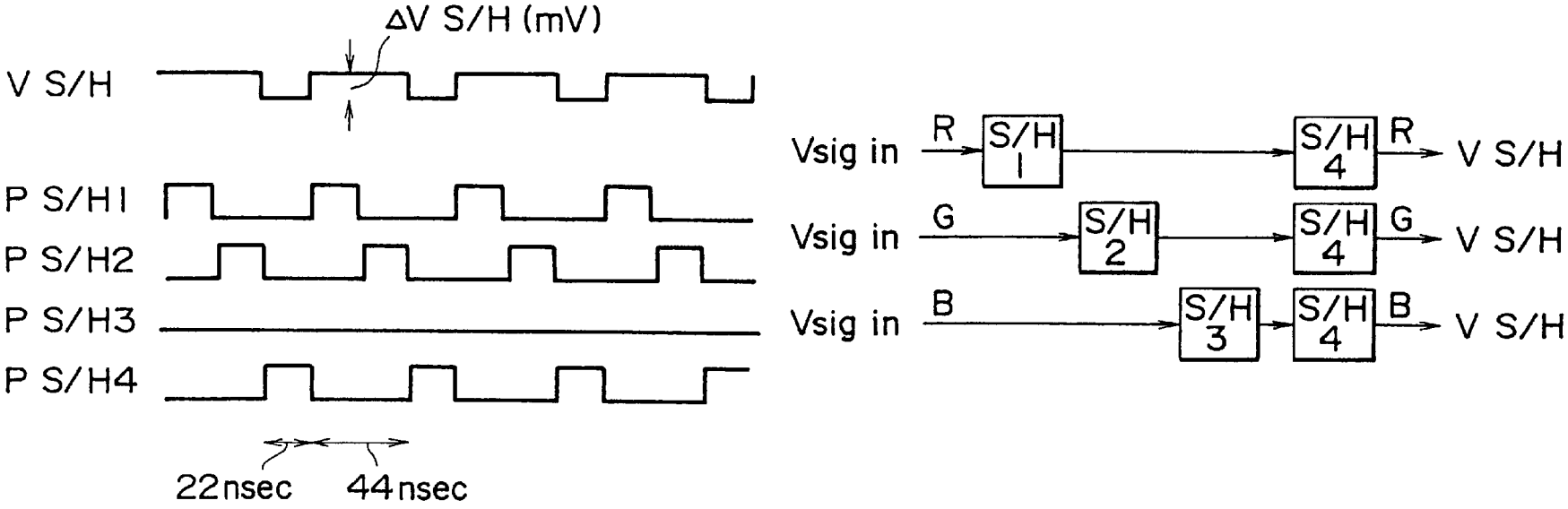
FIG. 12 is a schematic view illustrating simulation conditions in the graph shown in FIG. 11.

FIG. 12 illustrates conditions of the simulation illustrated in FIG. 11. While the related art arrangement employs, for the rear stage sample and hold units S/H4, a sample and hold unit having no noise removing function, the arrangement of the present invention employs, for the rear stage sample and hold units S/H4, a sample and hold unit which has an additional noise removing function. In the simulation, noises ΔVS/H included in the output video signals VS/H outputted for the individual three RGB systems were detected. In this instance, the on times of the latch signals PS/H were set to 22 nsec, and the off times were set to 44 nsec. Further, the rising time and the falling time of pulses forming the latch signals PS/H were set to 5 nsec. In addition, the potential level of the reference signal Vref was set to 2.5 V. Further, the potential level of the bias voltage Vbias was set to 1.6 V. The result of the simulation of the noises ΔVS/H conducted under the conditions described above is the graph of FIG. 11.

Figure 13:
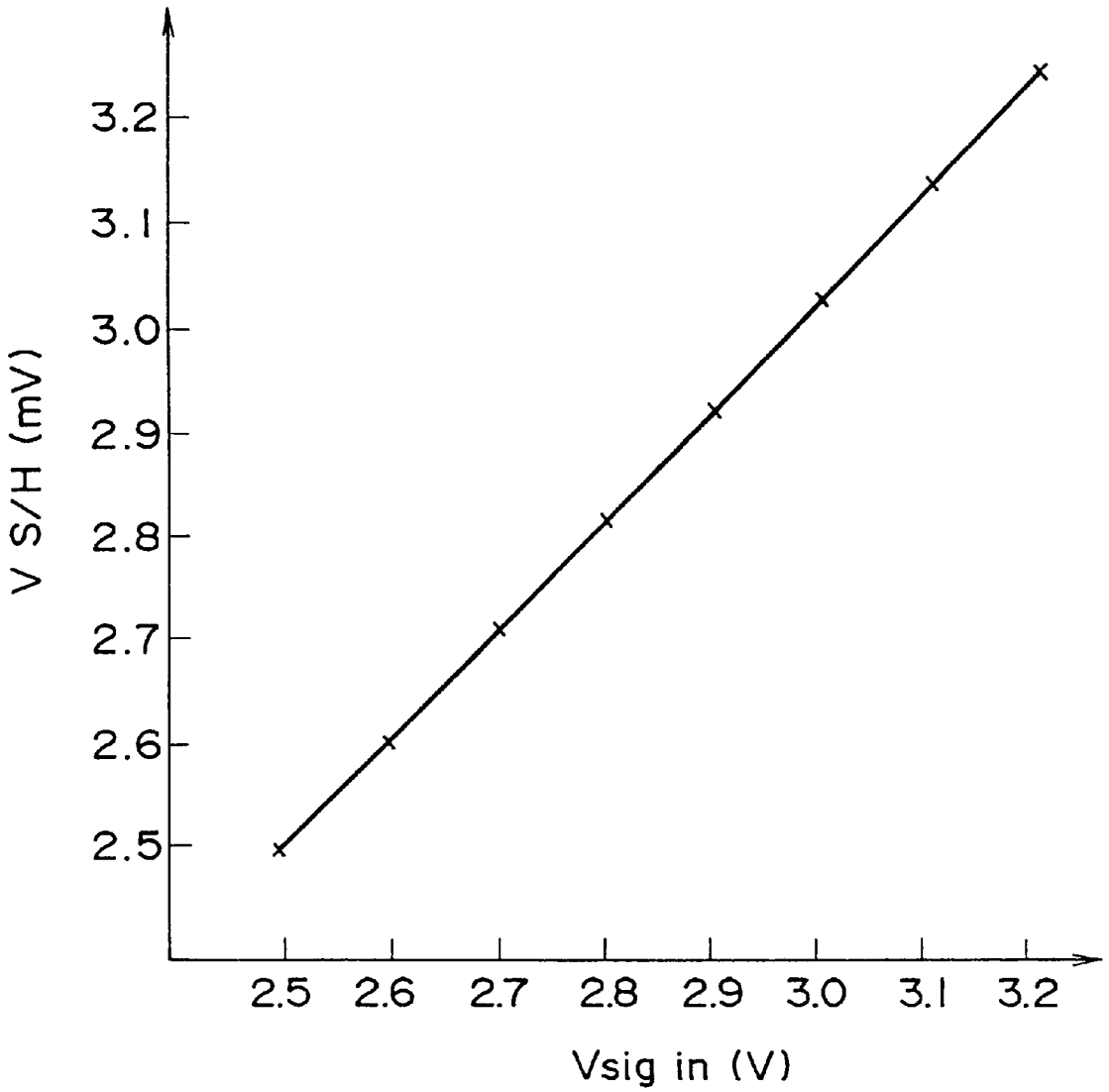
FIG. 13 is a graph illustrating a linearity between the input video signal and the output video signal of the video driver shown in FIG. 4.

FIG. 13 illustrates in graph a result of a simulation of the relationship between the input video signal Vsigin and the output video signal VS/H. As seen from FIG. 13, a sufficient linearity is maintained between the input video signal Vsigin and the output video signal VS/H, and it can be seen that the removing processing of sample and hold noise according to the present invention does not have any bad influence at all.

Having now fully described the invention, it will be apparent to one of ordinary skill in the art that many changes and modifications can be made thereto without departing from the spirit and scope of the invention as set forth herein.

What is claimed is:

1. A display apparatus, comprising:

a display panel including pixels arranged at intersecting points between gate lines and signal lines which extend perpendicularly to each other, and a driving circuit for simultaneously distributing a plurality of video signals to a plurality of said pixels;

a video driver for relatively delaying a plurality of original video signals in accordance with an arrangement pitch of said pixels to obtain the plurality of video signals and supplying the plurality of video signals to said display panel; and a timing generator for supplying a timing signal to said display panel and said video driver to synchronously control the simultaneous plural pixel driving of said driving circuit and the delaying processing of said video driver;

said video driver including first and second sampling stages, wherein said first sampling stage including first sample and hold means generates said delayed original video signals in response to the timing signal inputted thereto from said timing generator, and said second sampling stage includes second sample and hold means for repetitively sampling and holding the delayed original video signals inputted thereto from said first sampling stage in response to the timing signal inputted thereto from said timing generator, third sample and hold means for repetitively sampling and holding a predetermined reference signal in response to the timing signal, and a differential means for differentially processing the delayed original video and the reference signal after those signals have been sampled and held to produce video signals from which noise originating from the sampling and holding has been removed.

2. The display apparatus according to claim 1, wherein said third sample and hold means repetitively samples and holds the reference signal of a fixed voltage and intentionally adds noise originating from the sample and holding.

3. The circuit as claimed in claim 1, wherein said video driver comprises three signal channels.

4. The circuit as claimed in claim 3, wherein each of said channels comprises said first and second sampling stages in succession.

5. The circuit as claimed in claim 3, wherein said three channels each carry a particular color component of a video signal.

6. The display apparatus according to claim 1, wherein said first sampling stage includes a fourth sample and hold means for repetitively sampling and holding the original video signals inputted thereto in response to the timing signal inputted thereto from said timing generator, a fifth sample and hold means for repetitively sampling and holding said predetermined reference signal in response to the timing signal, and a second differential means for differentially processing the original video and the reference signal after those signals have been sampled and held to produce video signals from which noise original from the sample and holding has been removed.

7. A driving method for a display apparatus which includes a display panel having pixels arranged at intersecting points between gate lines and signal lines and a driving circuit for simultaneously distributing a plurality of video signals to drive a plurality of said pixels, a video driver including first and second sampling stages for relatively delaying a plurality of video signals in accordance with an arrangement pitch of said pixels to obtain the plurality of video signals and supplying the plurality of video signals to said display panel, said first sampling stage including first sample and hold means and said second sampling stage including second and third sample and hold means, and a timing generator for supplying a timing signal to said display panel and said video driver to synchronously control the simultaneous plural pixel driving of said driving circuit and the delay processing of said video driver, said driving method comprising the steps of:

repetitively sampling and holding, by means of said first sample and hold means in said first sampling stage, the original video signals to generate said delayed original video signals in response to the timing signal inputted from said timing generator;

repetitively sampling and holding, by means of said second sample and hold means in said second sampling stage, the delayed original video signals from said first sampling stage in response to the timing signal inputted from said timing generator;

repetitively sampling and holding, by means of said third sample and hold means in said second sampling stage, a predetermined reference signal simultaneously in response to the timing signal; and differentially processing the delayed original video signals and the reference signal after those signals have been sampled and held to produce a video signal from which noise originating from the sampling and holding has been removed.

8. The driving method for a display apparatus according to claim 7, wherein the reference signal has a fixed voltage and is repetitively sampled and held to intentionally add noise originating from the sampling and holding.

9. The driving method for a display apparatus according to claim 7, wherein said step of generating said delayed original video signals further comprises:

repetitively sampling and holding, by means of said first sampling stage, the original video signals in response to the timing signal inputted from said timing generator;

repetitively sampling and holding, by means of said first sampling stage, a predetermined reference signal simultaneously in response to the timing signal; and differentially processing the original video signals and the reference signal after those signals have been sampled and held to produce a video signal from which noise originating from the sampling and holding has been removed.

* * * * *